US007724115B2

(12) United States Patent
Chen et al.

(10) Patent No.: US 7,724,115 B2
(45) Date of Patent: May 25, 2010

(54) CIRCUIT CARRIER AND TRANSFORMER ASSEMBLY

(75) Inventors: Yi-Lin Chen, Taoyuan Hsien (TW); Hsin-Wei Tsai, Taoyuan Hsien (TW); Chia-Ching Lee, Taoyuan Hsien (TW); Shih-Yun Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/236,734

(22) Filed: Sep. 24, 2008

(65) Prior Publication Data

US 2010/0013590 A1 Jan. 21, 2010

(30) Foreign Application Priority Data

Jul. 15, 2008 (TW) ..... 97126793

(51) Int. Cl.

| | |
|---|---|
| ***H01F 27/30*** | (2006.01) |
| ***H01F 21/06*** | (2006.01) |
| ***H01F 21/02*** | (2006.01) |
| ***H01F 27/28*** | (2006.01) |
| ***H01F 27/29*** | (2006.01) |

(52) U.S. Cl. ..... 336/198; 336/131; 336/145; 336/182; 336/192; 336/208

(58) Field of Classification Search ..... None
See application file for complete search history.

(56) References Cited

U.S. PATENT DOCUMENTS

| | | | | |
|---|---|---|---|---|
| 4,879,620 | A * | 11/1989 | Yamashita | 360/123.17 |
| 5,497,283 | A * | 3/1996 | Kato | 360/123.11 |
| 5,534,839 | A * | 7/1996 | Mackin et al. | 336/192 |
| 6,078,240 | A * | 6/2000 | Huang | 336/90 |
| 6,147,583 | A * | 11/2000 | Rinne et al. | 336/200 |
| 6,239,683 | B1 * | 5/2001 | Roessler et al. | 336/200 |
| 6,563,056 | B1 * | 5/2003 | Belwon et al. | 174/260 |
| 6,792,667 | B2 * | 9/2004 | Roy et al. | 29/602.1 |
| 7,449,986 | B2 * | 11/2008 | Yamaguchi et al. | 336/192 |
| 7,528,694 | B2 * | 5/2009 | Tseng et al. | 336/212 |
| 2005/0073385 | A1 * | 4/2005 | Wu et al. | 336/208 |
| 2007/0268103 | A1 * | 11/2007 | Fushimi | 336/145 |
| 2008/0024261 | A1 * | 1/2008 | Shinmen et al. | 336/208 |
| 2009/0108976 | A1 * | 4/2009 | Nerone et al. | 336/192 |

* cited by examiner

*Primary Examiner*—Elvin G Enad
*Assistant Examiner*—Mangtin Lian
(74) *Attorney, Agent, or Firm*—Kirton & McConkie; Evan R. Witt

(57) ABSTRACT

The present invention relates to a circuit carrier and transformer assembly. The circuit carrier and transformer assembly includes a circuit carrier and a transformer. The transformer includes a bobbin with multiple bobbin bases. The circuit carrier includes multiple receiving holes corresponding to respective bobbin bases of the bobbin. The bobbin bases are received in respective bobbin bases when the transformer is mounted on the circuit carrier.

14 Claims, 6 Drawing Sheets

CIRCUIT CARRIER AND TRANSFORMER ASSEMBLY

FIELD OF THE INVENTION

The present invention relates to a circuit carrier and transformer assembly, and more particularly to a circuit carrier and transformer assembly with reduced height by partially receiving the transformer in multiple receiving holes of the circuit carrier.

BACKGROUND OF THE INVENTION

Generally, a circuit carrier (e.g. a printed circuit board) and a transformer are included in an electronic device such as a LCD television. The transformer is mounted on the circuit carrier to form a circuit carrier and transformer assembly. The transformer has become an essential electronic component for voltage regulation into required voltages for the electronic device.

FIG. 1 is a schematic exploded view illustrating a transformer and a circuit carrier according to prior art. As shown in FIG. 1, the transformer 1 is mounted on the circuit carrier 11. As shown in FIG. 1, the transformer 10 principally comprises a magnetic core assembly 12, a bobbin 13, a primary winding coil 14 and a secondary winding coil 15. The primary winding coil 14 and the secondary winding coil 15 are wound around a first winding part 131 and a second winding part 132 of the bobbin 13, respectively. In addition, a first side plate 131*a* and a second side plate 131*b* are arranged on opposite sides of the first winding part 131 of the bobbin 13. A third side plate 132*a* and a fourth side plate 132*b* are arranged on opposite sides of the second winding part 132 of the bobbin 13. The second side plate 131*b* of the first winding part 131 is separated from the third side plate 132*a* of the second winding part 132 by a gap d. Due to the gap d, a desired creepage distance is maintained between the primary winding coil 14 and the secondary winding coil 15. Moreover, two bobbin bases 16 are externally and vertically extended from the first side plate 131*a* of the first winding part 131 and the fourth side plate 132*b* of the second winding part 132, respectively. A plurality of pins 17 are disposed on the bobbin bases 16 and inserted into corresponding perforations (not shown) of the circuit carrier 11, so that the transformer 10 is fixed on the circuit carrier 11.

FIG. 2 is a schematic cross-sectional view illustrating a circuit carrier and transformer assembly shown in FIG. 1. Please refer to FIGS. 1 and 2. The circuit carrier and transformer assembly, however, still has some drawbacks. For example, after the pins 17 of the transformer 10 are inserted into corresponding perforations of the circuit carrier 11, the bobbin bases 16 of the transformer 10 are sustained against the surface of the circuit carrier 11. Since the bobbin bases 16 have inherent volume, the bobbin bases 16 occupy extra space above the circuit carrier 11. In other word, the circuit carrier and transformer assembly is detrimental to minimization and slimness of the electronic device. Moreover, since the gap d between the second side plate 131*b* of the first winding part 131 and the third side plate 132*a* of the second winding part 132 maintains the desired creepage distance between the primary winding coil 14 and the secondary winding coil 15, the second side plate 131*b* and the third side plate 132*a* are very close to the circuit carrier 11 after the transformer 10 is mounted on the circuit carrier 11. If the distance between the second side plate 131*b* (or the third side plate 132*a*) and the circuit carrier 11 is smaller than 1 mm, the creepage distance between the primary winding coil 14 and the secondary winding coil 15 is shortened and thus the electrical safety is reduced.

There is a need of providing a circuit carrier and transformer assembly to obviate the drawbacks encountered from the prior art.

SUMMARY OF THE INVENTION

It is an object of the present invention to provide a circuit carrier and transformer assembly so as to achieve minimization and slimness of the electronic device.

Another object of the present invention provides a circuit carrier and transformer assembly so as to increase electrical safety.

In accordance with an aspect of the present invention, there is provided a circuit carrier and transformer assembly. The circuit carrier and transformer assembly includes a circuit carrier and a transformer. The transformer includes a bobbin with multiple bobbin bases. The circuit carrier includes multiple receiving holes corresponding to respective bobbin bases of the bobbin. The bobbin bases are received in respective bobbin bases when the transformer is mounted on the circuit carrier.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
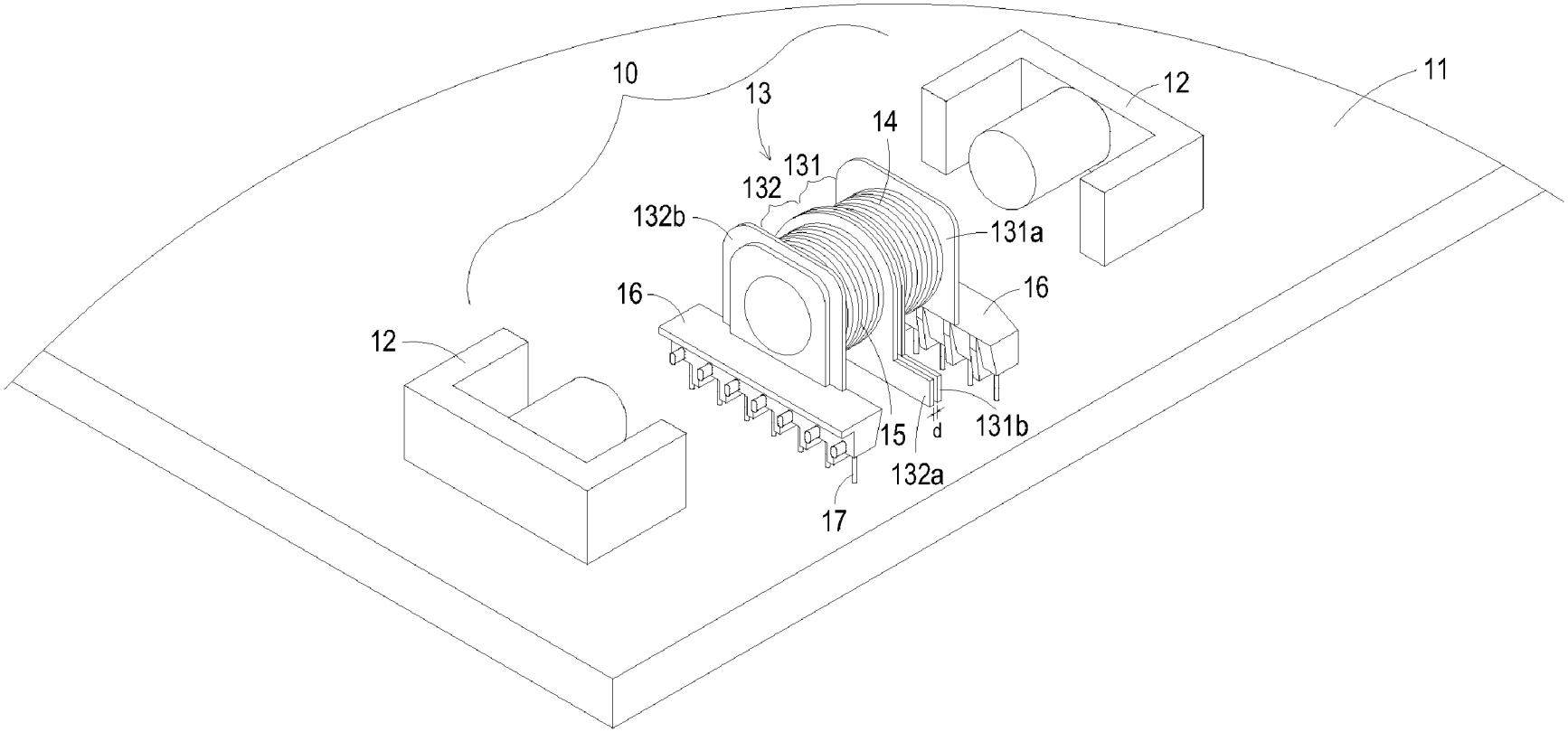
FIG. 1 PRIOR ART
FIG. 1 is a schematic exploded view illustrating a transformer and a circuit carrier according to prior art.
Figure 2:
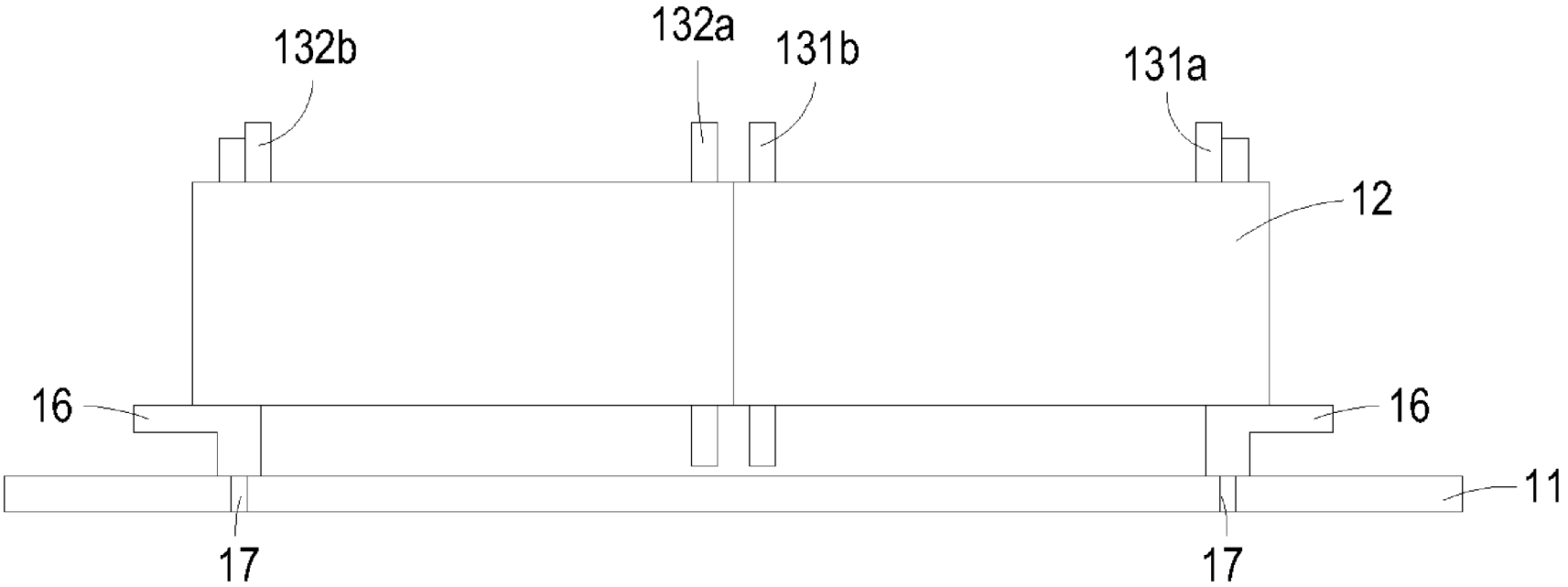
FIG. 2 PRIOR ART
FIG. 2 is a schematic cross-sectional view illustrating a circuit carrier and transformer assembly shown in FIG. 1.
Figure 3:
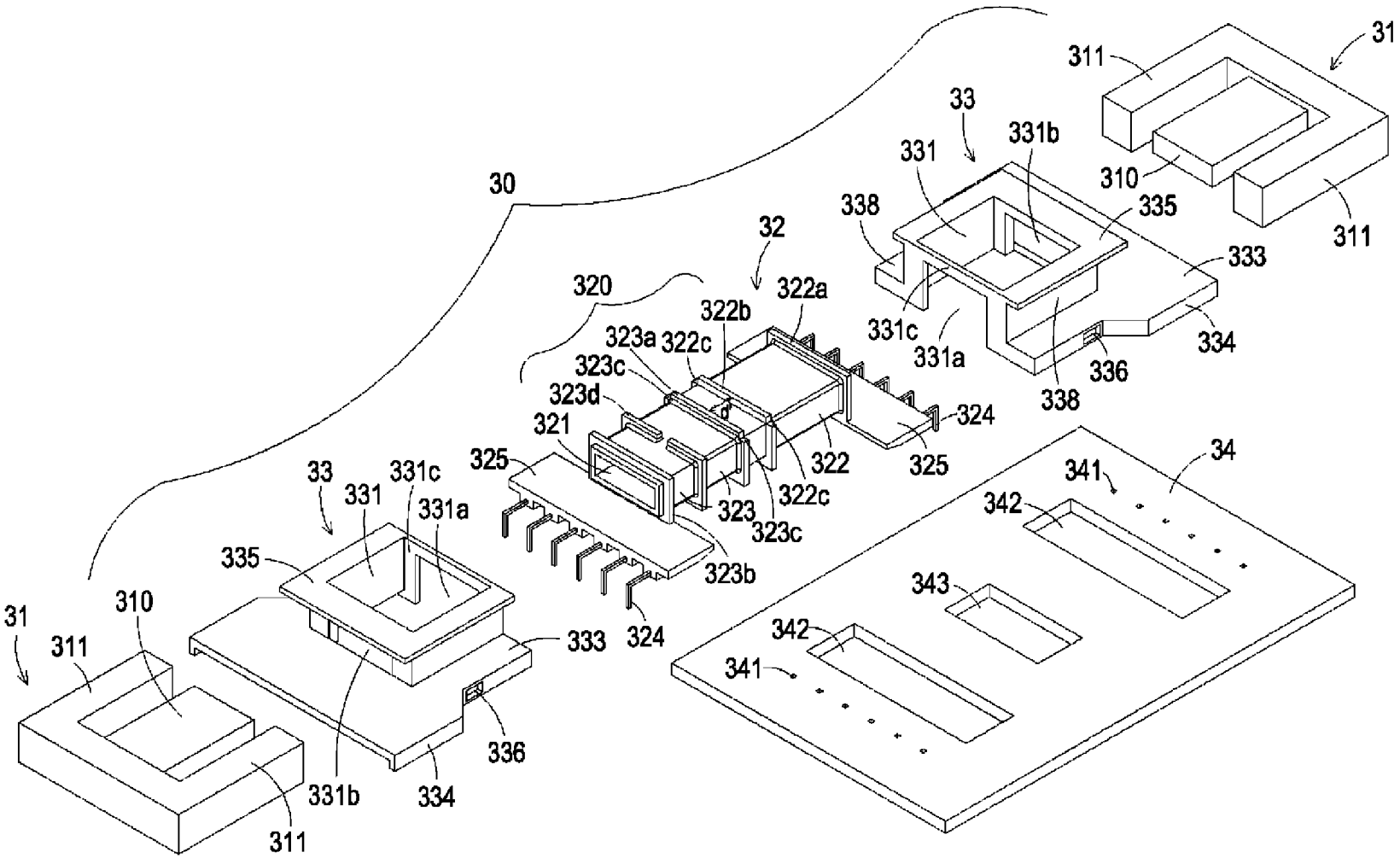
FIG. 3 is a schematic exploded view illustrating a transformer and a circuit carrier according to a preferred embodiment of the present invention.
Figure 4:
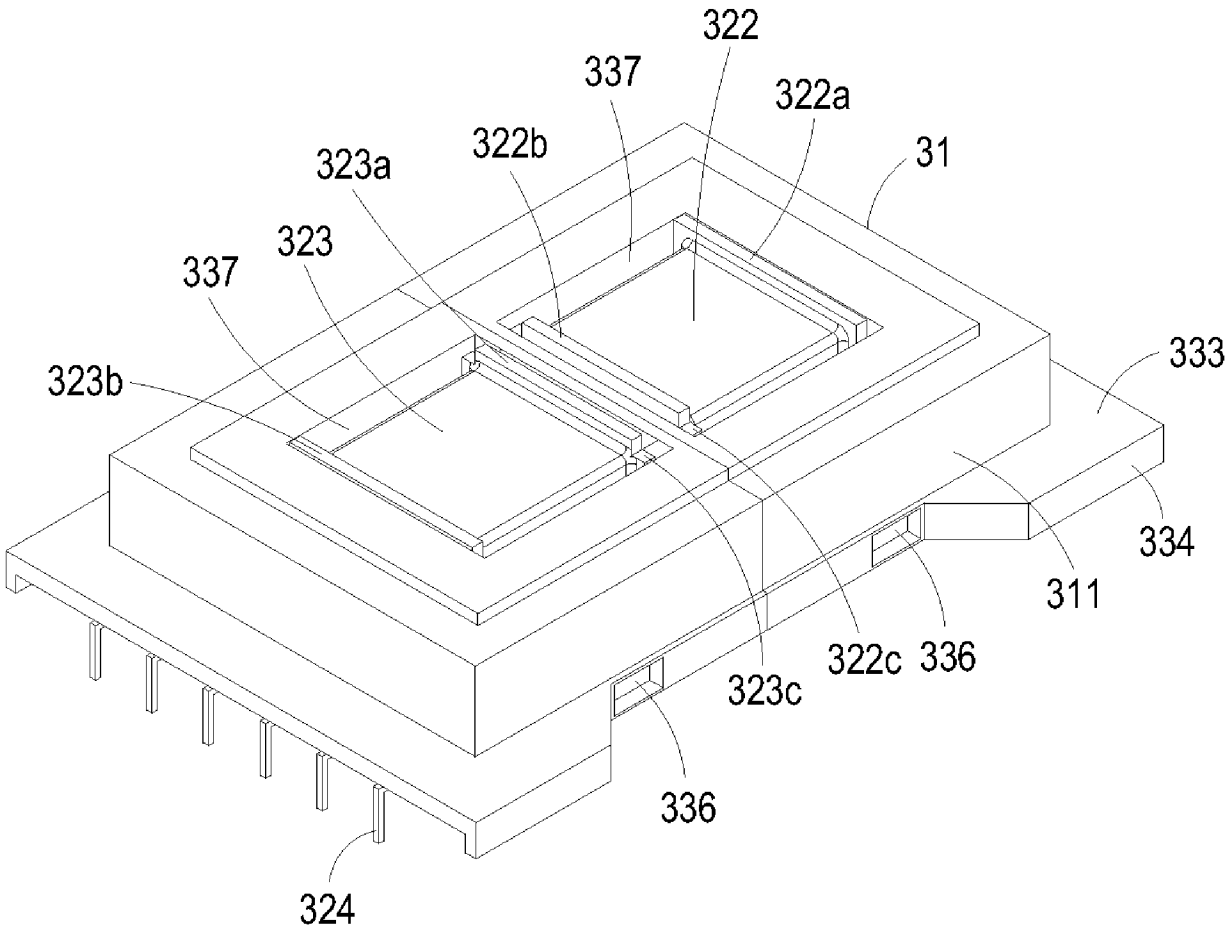
FIG. 4 is a schematic assembled view illustrating a circuit carrier and transformer assembly shown in FIG. 3.
Figure 5:
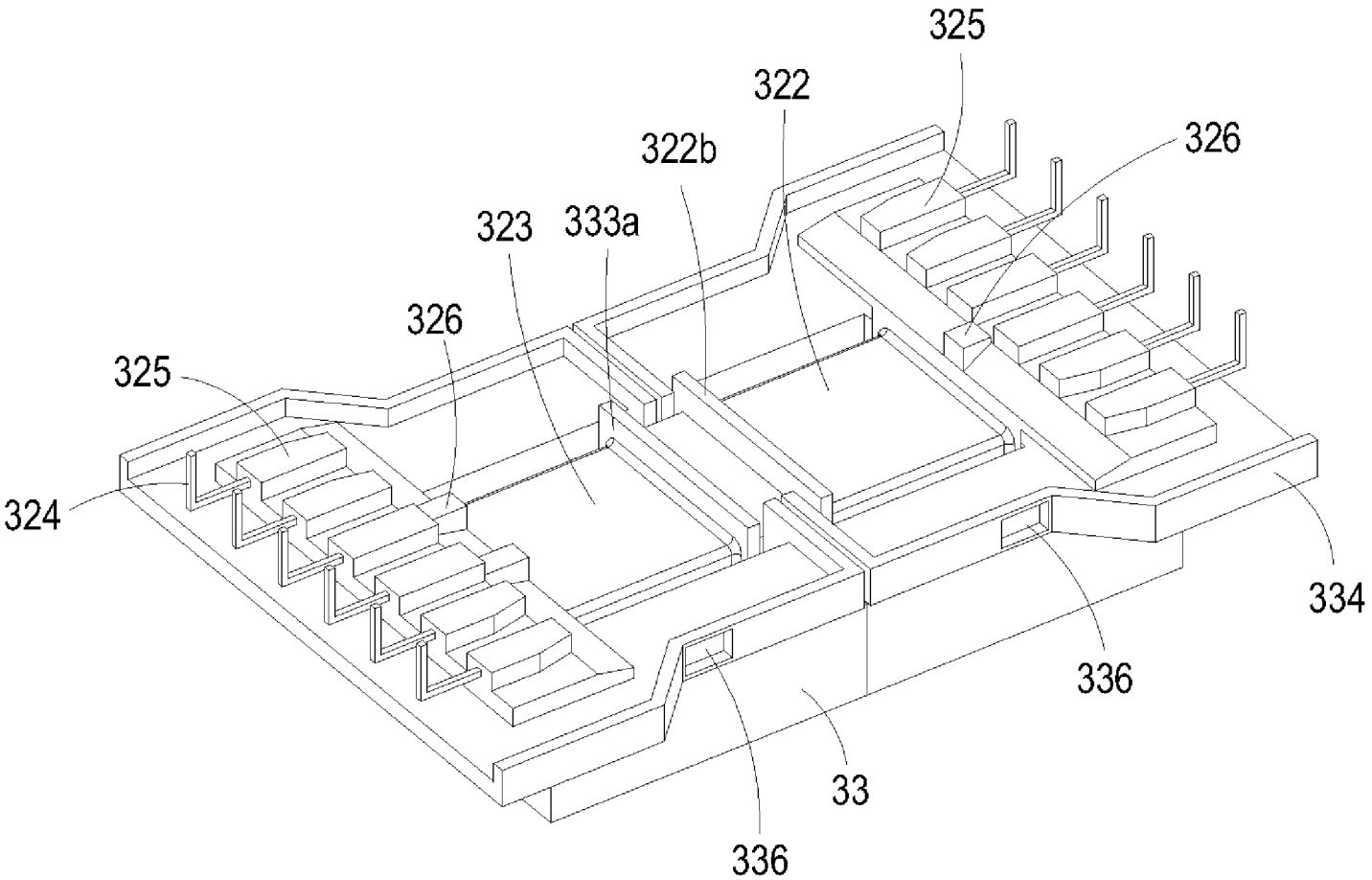
FIG. 5 is an upside-down view of the circuit carrier and transformer assembly shown in FIG. 4.

FIG. 3 is a schematic exploded view illustrating a transformer and a circuit carrier according to a preferred embodiment of the present invention. FIG. 4 is a schematic assembled view illustrating a circuit carrier and transformer assembly shown in FIG. 3. FIG. 5 is an upside-down view of the circuit carrier and transformer assembly shown in FIG. 4. The transformer 30 and the circuit carrier 34 are included in an electronic device such as a LCD television.

Please refer to FIGS. 3, 4 and 5. The transformer 30 is mounted on the circuit carrier 34, and principally comprises a magnetic core assembly 31, a bobbin 32 and a plurality of shielding members 33. The magnetic core assembly 31 includes two magnetic parts, which are cooperatively formed as for example an EE-type core assembly. Each magnetic part has a middle portion 310 and two leg portions 311. The leg portions 311 are arranged on bilateral sides of the middle portion 310.

The bobbin 32 includes a winding section 320 and a first channel 321. The first channel 321 passes through the inner portion of the winding section 320. The middle portions 310 of the magnetic core assembly 31 are embedded into the first channel 321 of the bobbin 32. The winding section 320 includes a first winding part 322 and a second winding part 323. A primary winding coil (not shown) and a secondary winding coil (not shown) are wound around the first winding part 322 and the second winding part 323, respectively. The primary winding coil and the secondary winding coil interact with the magnetic core assembly 31 to achieve the purpose of voltage regulation.

In some embodiments, a first side plate 322*a* and a second side plate 322*b* are arranged on opposite sides of the first winding part 322 of the bobbin 32. A third side plate 323*a* and a fourth side plate 323*b* are arranged on opposite sides of the second winding part 323 of the bobbin 32. The second side plate 322*b* of the first winding part 322 has two concave portions 322*c* at bilateral upper corners thereof. Corresponding to the concave portions 322*c*, the third side plate 323*a* of the second winding part 323 has two concave portions 323*c* at bilateral upper corners thereof. The concave portions 322*c* and 323*c* may enhance the creepage distance between the primary winding coil and the secondary winding coil.

Furthermore, the second side plate 322*b* of the first winding part 322 is separated from the third side plate 323*a* of the second winding part 323 by a gap d'. The gap d' may also enhance the creepage distance between the primary winding coil and the secondary winding coil. In some embodiments, the second winding part 323 further includes a partition plate 323*d* between the third side plate 323*a* and the fourth side plate 323*b*. By the partition plate 323*d*, the secondary winding coil is wound around the second winding part 323 in two portions so as to enhance the heat-dissipating efficiency of the secondary winding coil.

In some embodiments, the bobbin 32 has a plurality of bobbin bases 325 and a plurality of pins 324. For example, two bobbin bases 325 are externally and vertically extended from the first side plate 322*a* of the first winding part 322 and the fourth side plate 323*b* of the second winding part 323, respectively. The pins 324 are for example L-shaped. The pins 324 have respective first ends fixed in the bobbin bases 325 and respective second ends inserted into corresponding perforations (not shown) of the circuit carrier 34.

In some embodiments, the shielding members 33 are separated from each other for shielding the bobbin 32. Each shielding members 33 includes a receiving part 331, a bottom plate 333, a first extension plates 334 and a second extension plate 335. The first extension plate 334 is downwardly and vertically extended from bilateral sides of the bottom plate 333. At least one ventilation hole 336 is formed in the first extension plate 334 for enhancing convection and heat-dissipation.

Please refer to FIGS. 3, 4 and 5 again. The receiving part 331 has a hollow portion disposed in the center thereof and defined by four sidewalls. The receiving part 331 has a first opening 331*a* and a second opening 331*b*, which are formed in two opposite sidewalls of the receiving part 331. For example, the first opening 331*a* is formed in the first sidewall of the receiving part 331. After the first winding part 322 and the second winding part 323 of the bobbin 32 are inserted into the receiving parts 331 through the first openings 331*a*, the first winding part 322 and the second winding part 323 are received in the receiving parts 331. Meanwhile, the first sidewall 331*c* of the receiving part 331 is arranged between the second side plate 322*b* of the first winding part 322 and the third side plate 323*a* of the second winding part 323 in order to further enhance the creepage distance between the primary winding coil and the secondary winding coil. Moreover, the hollow upper side of the receiving part 331 may maintain the creepage distance between the primary winding coil and the secondary winding coil so as to increase electrical safety of the transformer 30.

Please refer to FIGS. 3, 4 and 5 again. After the first winding part 322 and the second winding part 323 of the bobbin 32 are inserted into the receiving parts 331 through the first openings 331*a*, the second openings 331*b* of the receiving part 331 are communicated with the first channel 321 of the bobbin 32 such that the middle portions 310 of the magnetic core assembly 31 may be embedded into the first channel 321 of the bobbin 32 through the second openings 331*b*. Furthermore, the second extension plates 335 are externally and vertically extended from the upper sides of the receiving parts 331. For each shielding member 33, two recesses 338 are defined between the second extension plate 335, the bottom plate 333 and the external surfaces of two sidewalls of the receiving part 331. When the middle portions 310 of the magnetic core assembly 31 are embedded into the first channel 321 of the bobbin 32 through the second openings 331*b* of the shielding members 33, the leg portions 311 of the magnetic core assembly 31 are received in corresponding recesses 338. After the magnetic core assembly 31, the bobbin 32 and the shielding member 33 are assembled as the transformer 30 shown in FIGS. 4 and 5, an insulation tape (not shown) is wound around the outer surface of the transformer 30 so as to securely combine the magnetic core assembly 31, the bobbin 32 and the shielding member 33 together.

Please refer to FIGS. 3, 4 and 5 again. The circuit carrier 34 (e.g. a printed circuit board) is used for supporting the transformer 30. The circuit carrier 34 has several perforations 341 and several receiving holes 342. The locations of the perforations 341 are aligned with corresponding pins 324 of the bobbin 32 of the transformer 30. After the pins 324 of the bobbin 32 are inserted into the perforations 341 of the circuit carrier 34, the transformer 30 is fixed on the circuit carrier 34. The locations of the receiving holes 342 are aligned with corresponding bobbin bases 325 of the transformer 30. The dimension of each receiving hole 342 is substantially equal to that of a corresponding bobbin base 325. When the pins 324 of the bobbin 32 are inserted into the perforations 341 of the circuit carrier 34, the bobbin bases 325 of the transformer 30 are received in corresponding receiving holes 342. As a consequence, the overall height of the transformer 30 with respect to the circuit carrier 34 is reduced.

In some embodiment, the circuit carrier 34 has a slot 343 between the receiving holes 342 and corresponding to the range of from the second side plate 322*b* of the first winding part 322 to the third side plate 323*a* of the second winding part 323. That is, the dimension of the slot 343 is substantially equal to the shadow area from the second side plate 322*b* of the first winding part 322 to the third side plate 323*a* of the second winding part 323. After the transformer 30 is mounted on the circuit carrier 34, the second side plate 322*b* of the first winding part 322 and the third side plate 323*a* of the second winding part 323 are disposed above the slot 343. The slot 343 may increase the minimum distance between the second side plate 322*b* of the first winding part 322 (or the third side plate 323*a* of the second winding part 323) and the circuit carrier 34 so as to increase electrical safety of the transformer 30.

Figure 6:
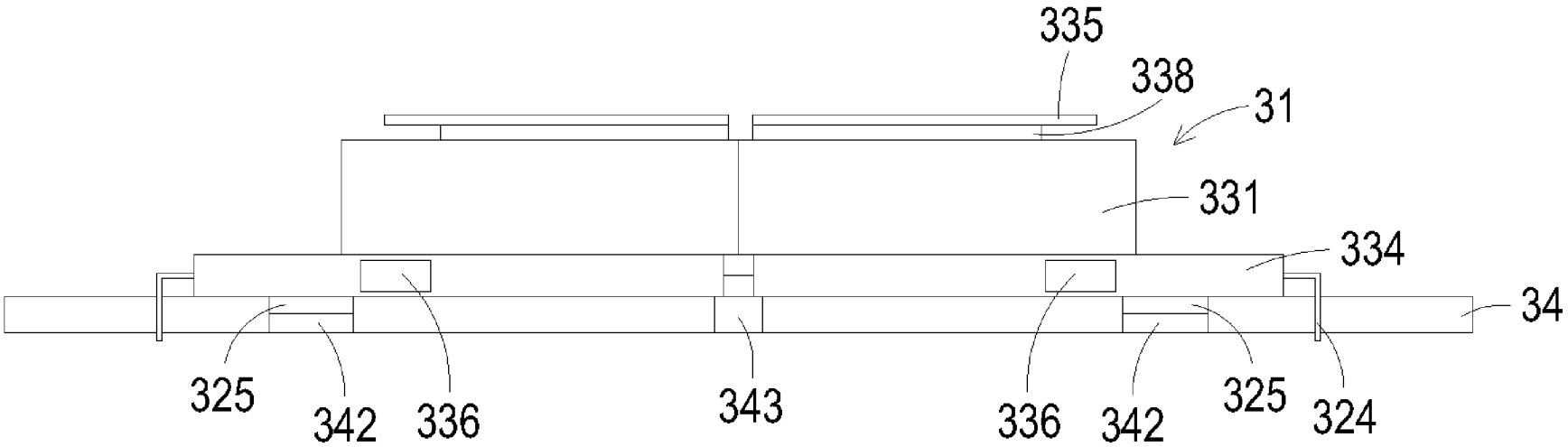
FIG. 6 is a schematic cross-sectional view illustrating a circuit carrier and transformer assembly shown in FIG. 4.

FIG. 6 is a schematic cross-sectional view illustrating a circuit carrier and transformer assembly shown in FIG. 4. Hereinafter, a process of fabricating the circuit carrier and transformer assembly according to the present invention will be illustrated with reference to FIGS. 3, 4, 5 and 6. First of all, the bobbin 32 is shielded by the shielding members 33 such that the first winding part 322 and the second winding part 323 are received in the receiving parts 331 of respective shielding members 33 and the first channel 321 of the bobbin 32 is communicated with the second openings 331*a* of the shielding members 33. Meanwhile, the first sidewall 331*c* of the receiving part 331 is arranged between the second side plate 322*b* of the first winding part 322 and the third side plate 323*a* of the second winding part 323. Next, the middle portions 310 of the magnetic core assembly 31 are embedded into the first channel 321 of the bobbin 32 through the second openings 331*b* of the shielding members 33 and the leg portions 311 of the magnetic core assembly 31 are received in corresponding recesses 338. After the magnetic core assembly 31, the bobbin 32 and the shielding member 33 are assembled as the transformer 30, an insulation tape (not shown) is wound around the outer surface of the transformer 30. Next, the pins 324 of the bobbin 32 of the transformer 30 are aligned with corresponding perforations 341 of the circuit carrier 34 and the bobbin bases 325 of the transformer 30 are aligned with corresponding receiving holes 342 of the circuit carrier 34. Afterwards, the pins 324 are inserted into corresponding perforations 341 and the bobbin bases 325 are received in corresponding receiving holes 342 such that the transformer 30 is mounted on the circuit carrier 34. Under this circumstance, the second side plate 322*b* of the first winding part 322 and the third side plate 323*a* of the second winding part 323 are disposed above the slot 343. Since the bobbin bases 325 are partially received in corresponding receiving holes 342 of the circuit carrier 34, the overall height of the circuit carrier and transformer assembly is reduced.

Moreover, for facilitating fixing the transformer 30 on the circuit carrier 34 and preventing deformation of the pins 324, the transformer 30 further includes one or more sustaining elements 326 as shown in FIG. 5. The sustaining elements 326 are disposed beside the bobbin bases 325. When the bobbin bases 325 are partially received in corresponding receiving holes 342 of the circuit carrier 34, the sustaining elements 326 are sustained against the surface of the circuit carrier 34 and adjacent to the receiving holes 342 so as to assist the pins in supporting the transformer 30.

From the above description, the circuit carrier and transformer assembly according to the present invention has reduced height by partially receiving the bobbin bases of the transformer in corresponding receiving holes of the circuit carrier. As a consequence, the electronic device with the circuit carrier and transformer assembly can meet the requirements of minimization and slimness. Moreover, since the slot of the circuit carrier may increase the minimum distance between the second side plate of the first winding part (or the third side plate of the second winding part) and the circuit carrier, the creepage distance between the primary winding coil and the secondary winding coil is enhanced so as to increase the electrical safety of the electronic device.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A circuit carrier and transformer assembly, comprising:

a transformer comprising a bobbin with multiple bobbin bases, wherein said bobbin has a winding section comprising a first winding part and a second winding part, wherein a primary winding coil and a secondary winding coil are wound around the first winding part and a second winding part, respectively, wherein a first side plate and a second side plate are arranged on opposite sides of said first winding part, and a third side plate and a fourth side plate are arranged on opposite sides of the second winding part, wherein said second side plate of said first winding part is separated from said third side plate of said second winding part by a gap; and a circuit carrier comprising multiple receiving holes corresponding to respective bobbin bases of the bobbin, wherein said bobbin bases are received in respective receiving holes when said transformer is mounted on said circuit carrier, wherein said circuit carrier further has a slot corresponding to the range of from said second side plate of said first winding part to said third side plate of said second winding part, thereby maintaining a creepage distance between said primary winding coil and said secondary winding coil when said transformer is mounted on said circuit carrier.

2. The circuit carrier and transformer assembly according to claim 1 wherein said transformer further comprises multiple shielding members for shielding said bobbin, and each shielding member includes a receiving part, a bottom plate and a first extension plate.

3. The circuit carrier and transformer assembly according to claim 2 wherein each of said shielding members has a hollow upper side to maintain the creepage distance between said primary winding coil and said secondary winding coil after said bobbin is shielded by said shielding members.

4. The circuit carrier and transformer assembly according to claim 2 wherein said first extension plate is downwardly and vertically extended from bilateral sides of said bottom plate and has at least one ventilation hole.

5. The circuit carrier and transformer assembly according to claim 2 wherein said first winding part and said second winding part of said bobbin are received in receiving parts of respective shielding members.

6. The circuit carrier and transformer assembly according to claim 5 wherein first sidewalls of respective receiving parts are arranged between said second side plate of said first winding part and said third side plate of said second winding part after said first winding part and said second winding part of said bobbin are received in receiving parts of respective shielding members.

7. The circuit carrier and transformer assembly according to claim 1 wherein each of said second side plate of said first winding part and said third side plate of said second winding part has two concave portions at bilateral upper corners thereof.

8. The circuit carrier and transformer assembly according to claim 1 wherein said second winding part further comprises a partition plate between said third side plate and said fourth side plate such that said secondary winding coil is wound around said second winding part in two portions.

9. The circuit carrier and transformer assembly according to claim 1 wherein said transformer further comprises multiple pins, which are disposed on said bobbin bases.

10. The circuit carrier and transformer assembly according to claim 9 wherein said circuit carrier comprises multiple perforations corresponding to said pins of said transformer, and said pins are inserted on said perforations so as to fix said transformer on said circuit carrier.

11. The circuit carrier and transformer assembly according to claim 9 wherein said pins are L-shaped.

12. The circuit carrier and transformer assembly according to claim 9 wherein said transformer further comprises at least one sustaining element beside said bobbin bases and sustained against said circuit carrier, thereby assisting said pins in supporting said transformer.

13. The circuit carrier and transformer assembly according to claim 1 wherein said transformer further comprises a magnetic core assembly, which is partially embedded into said bobbin.

14. The circuit carrier and transformer assembly according to claim 1 wherein said circuit carrier is a printed circuit board.

* * * * *